US010749240B1

(12) United States Patent
Ochoa et al.

(10) Patent No.: US 10,749,240 B1
(45) Date of Patent: Aug. 18, 2020

(54) VENTILATED CONCEALMENT SYSTEM FOR ANTENNA TRANSMISSION COMPONENTS ON A TOWER

(71) Applicant: EHRESMANN ENGINEERING, INC., Yankton, SD (US)

(72) Inventors: Derek Ochoa, Yankton, SD (US); Gregg Ehresmann, Yankton, SD (US)

(73) Assignee: Ehresmann Engineering, Inc., Yankton, SD (US)

( * ) Notice: Subject to any disclaimer, the term of this patent is extended or adjusted under 35 U.S.C. 154(b) by 0 days.

(21) Appl. No.: 16/564,315

(22) Filed: Sep. 9, 2019

Related U.S. Application Data

(60) Provisional application No. 62/774,394, filed on Dec. 3, 2018.

(51) Int. Cl.
*H01Q 1/02* (2006.01)
*H01Q 1/42* (2006.01)

(52) U.S. Cl.
CPC ..... *H01Q 1/02* (2013.01); *H01Q 1/42* (2013.01)

(58) Field of Classification Search
CPC ..... H01Q 1/42; H01Q 1/40
USPC ..... 52/651.01
See application file for complete search history.

(56) References Cited

U.S. PATENT DOCUMENTS

| | | | | |
|---|---|---|---|---|
| 5,349,362 | A * | 9/1994 | Forbes | H01Q 1/42 343/701 |
| 6,658,797 | B2 * | 12/2003 | Jones | H01Q 1/246 343/890 |
| 9,711,846 | B2 * | 7/2017 | Dundorf | H01Q 1/42 |
| 9,742,886 | B2 * | 8/2017 | Hansen, Sr. | H04M 1/0283 |
| 10,321,591 | B2 * | 6/2019 | Lapham | H02J 7/0042 |
| 2005/0007295 | A1 * | 1/2005 | Janoschka | H01Q 1/1242 343/890 |
| 2005/0030250 | A1 * | 2/2005 | Gottl | H01Q 1/246 343/878 |
| 2018/0062247 | A1 * | 3/2018 | Umbert | G09F 15/0043 |
| 2018/0277921 | A1 * | 9/2018 | Ming | H01Q 1/12 |
| 2018/0323503 | A1 * | 11/2018 | Bouchard | H01Q 1/42 |

* cited by examiner

*Primary Examiner* — Paola Agudelo
(74) *Attorney, Agent, or Firm* — Jeffrey A. Proehl; Woods, Fuller, Shultz & Smith, PC

(57) ABSTRACT

A transmission antenna system may include an elongate upstanding main pole, an antenna support assembly extending upwardly from the main pole, at least one antenna mounted on the antenna support assembly, and a concealment assembly mounted on the antenna support assembly and configured to conceal from view the antenna support assembly and the at least one antenna.

20 Claims, 25 Drawing Sheets

VENTILATED CONCEALMENT SYSTEM FOR ANTENNA TRANSMISSION COMPONENTS ON A TOWER

REFERENCE TO RELATES APPLICATION

This application claims the benefit of U.S. Provisional Patent Application No. 62/774,394 filed Dec. 3, 2018, which is hereby incorporated by reference in its entirety.

BACKGROUND

Field

The present disclosure relates to aerial structures and more particularly pertains to a new ventilated concealment system for antenna transmission components on a tower which may have a ventilation benefits for components concealed by the concealment system.

SUMMARY

In one aspect, the present disclosure relates to a transmission antenna system which may include an elongate upstanding main pole, an antenna support assembly extending upwardly from the main pole, at least one antenna mounted on the antenna support assembly, and a concealment assembly mounted on the antenna support assembly and configured to conceal from view the antenna support assembly and the at least one antenna In another aspect, the disclosure relates to a transmission antenna system that may comprise an elongate upstanding main pole, an antenna support assembly extending upwardly from the main pole, at least one antenna mounted on the antenna support assembly, and a concealment assembly mounted on the antenna support assembly and configured to conceal from view the antenna support assembly and the at least one antenna. The concealment assembly may include a plurality of concealment panels positioned in an array about the antenna support assembly and the at least one antenna. At least one of the concealment panels may have at least one ventilation slot therethrough.

In still another aspect, the disclosure relates to a concealment assembly for mounting on a transmission antenna apparatus including an elongate upstanding main pole and an antenna support assembly extending upwardly from the main pole to conceal from view the antenna support assembly. The concealment assembly may comprise a plurality of concealment panels positionable in an array about the antenna support assembly and the at least one antenna, with each of the concealment panels being elongated with elongated side edges. The assembly may also include a plurality of joiner panels configured to join adjacent concealment panels, with each joiner panel being configured to join adjacent side edges of the adjacent concealment panels. The assembly may also have an adapting frame structure configured to mount the concealment panels and the joiner panels on the antenna support assembly. One or more of the plurality of concealment panels may have a plurality of ventilation slots therethrough.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
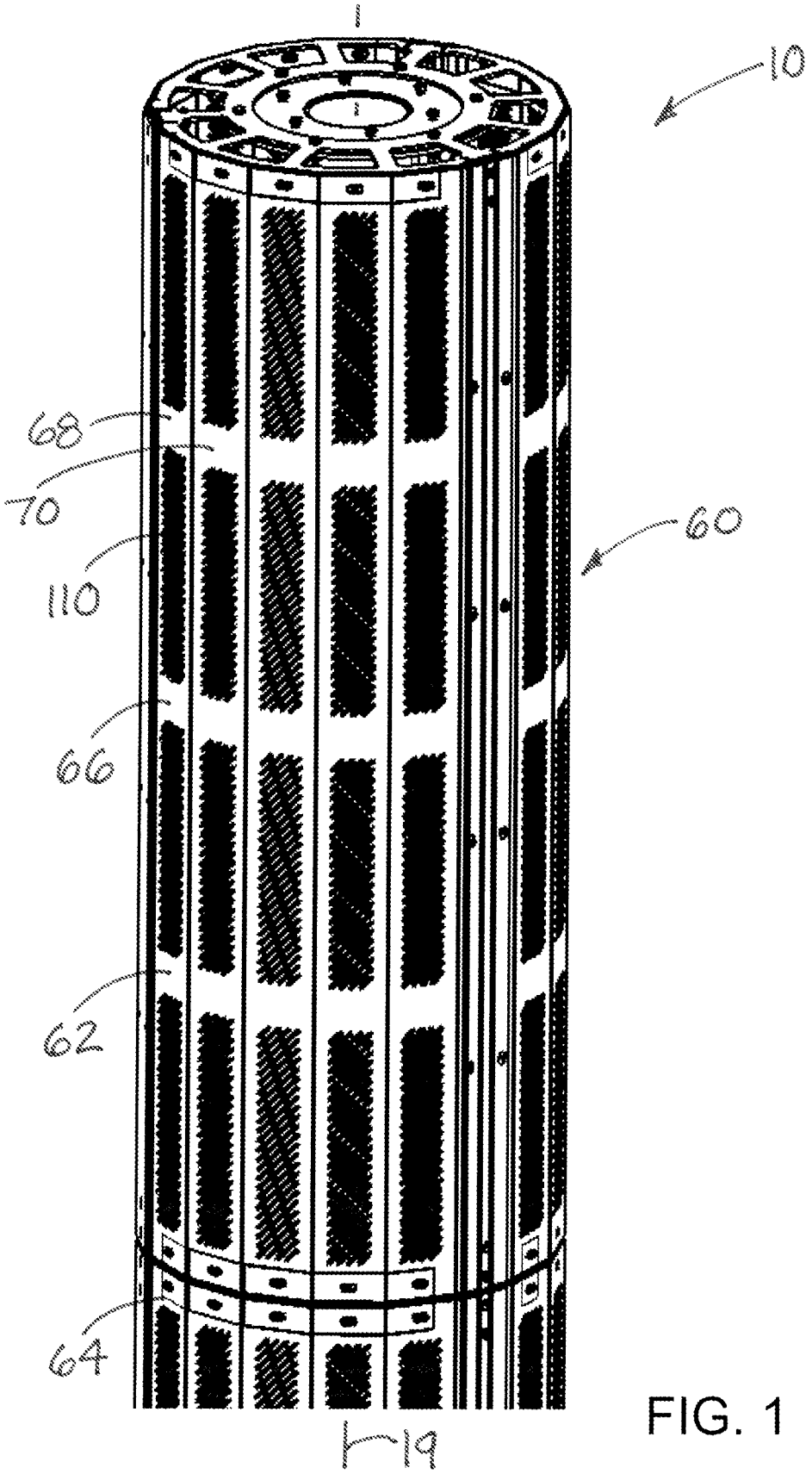
FIG. 1 is a schematic side view of an upper portion of a new ventilated concealment system for antenna transmission components on a tower according to the present disclosure.
Figure 2:
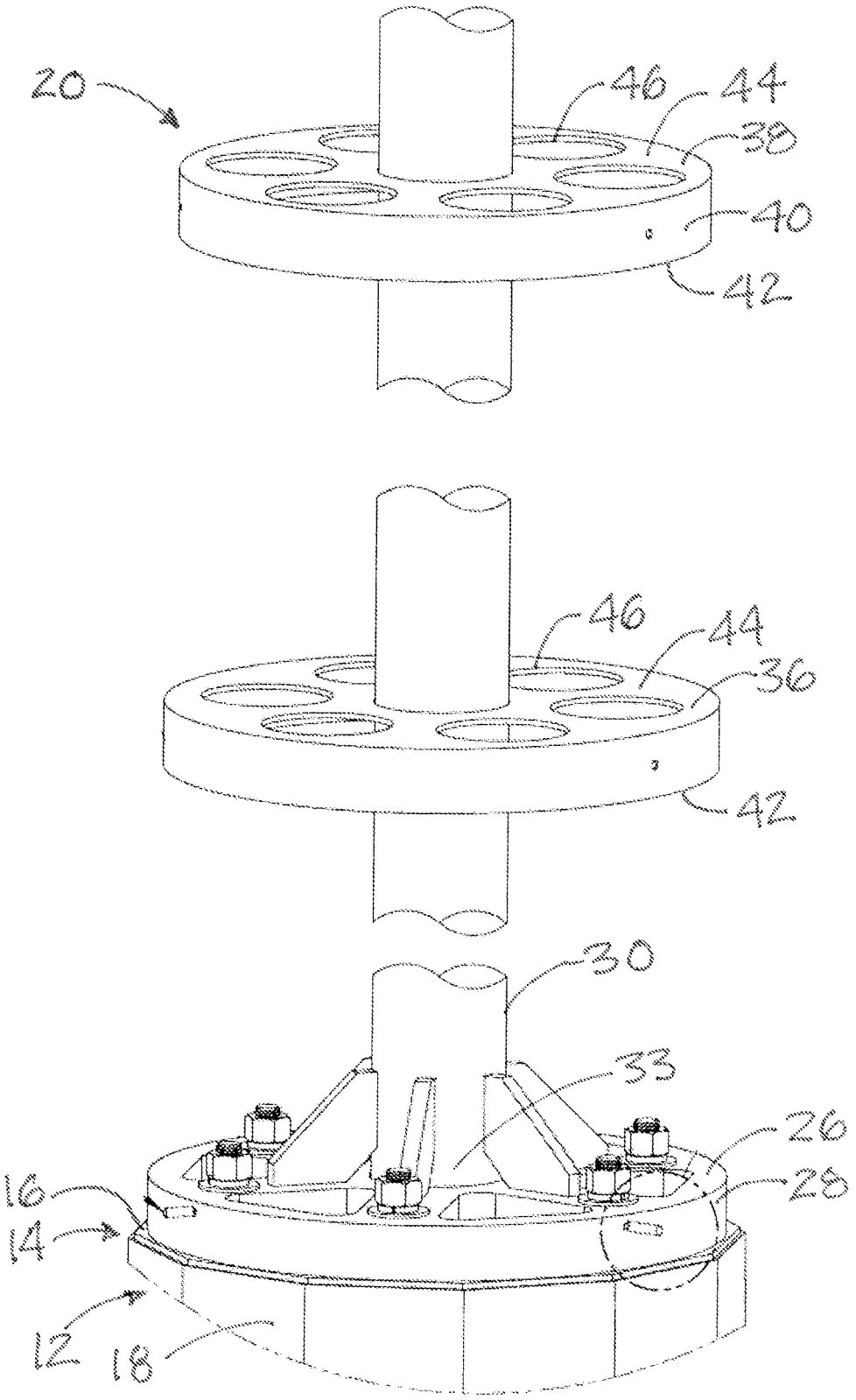
FIG. 2 is a schematic side view of elements of the antenna support assembly, according to an illustrative embodiment.
Figure 3:
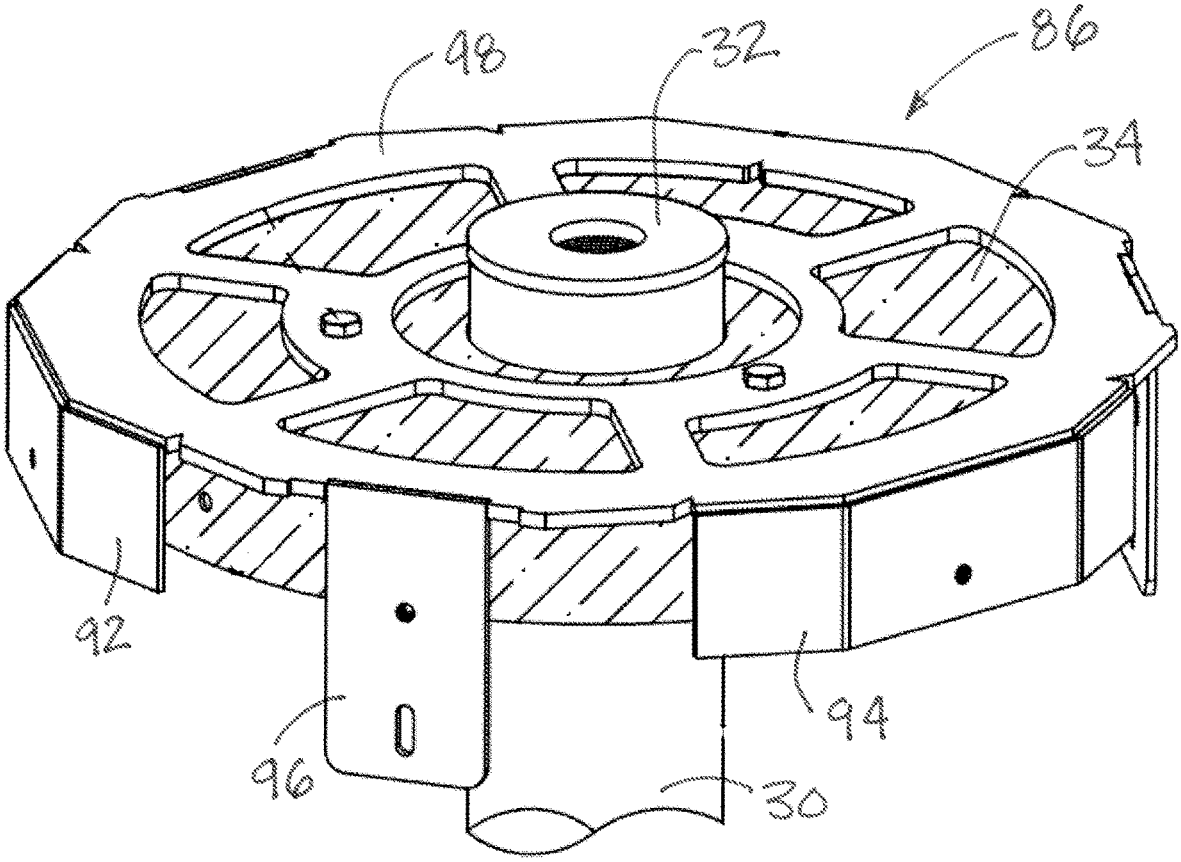
FIG. 3 is a schematic perspective view of aspects of the adapting frame structure of the concealment assembly with respect to an uppermost support of the antenna support assembly, according to an illustrative embodiment.
Figure 4:
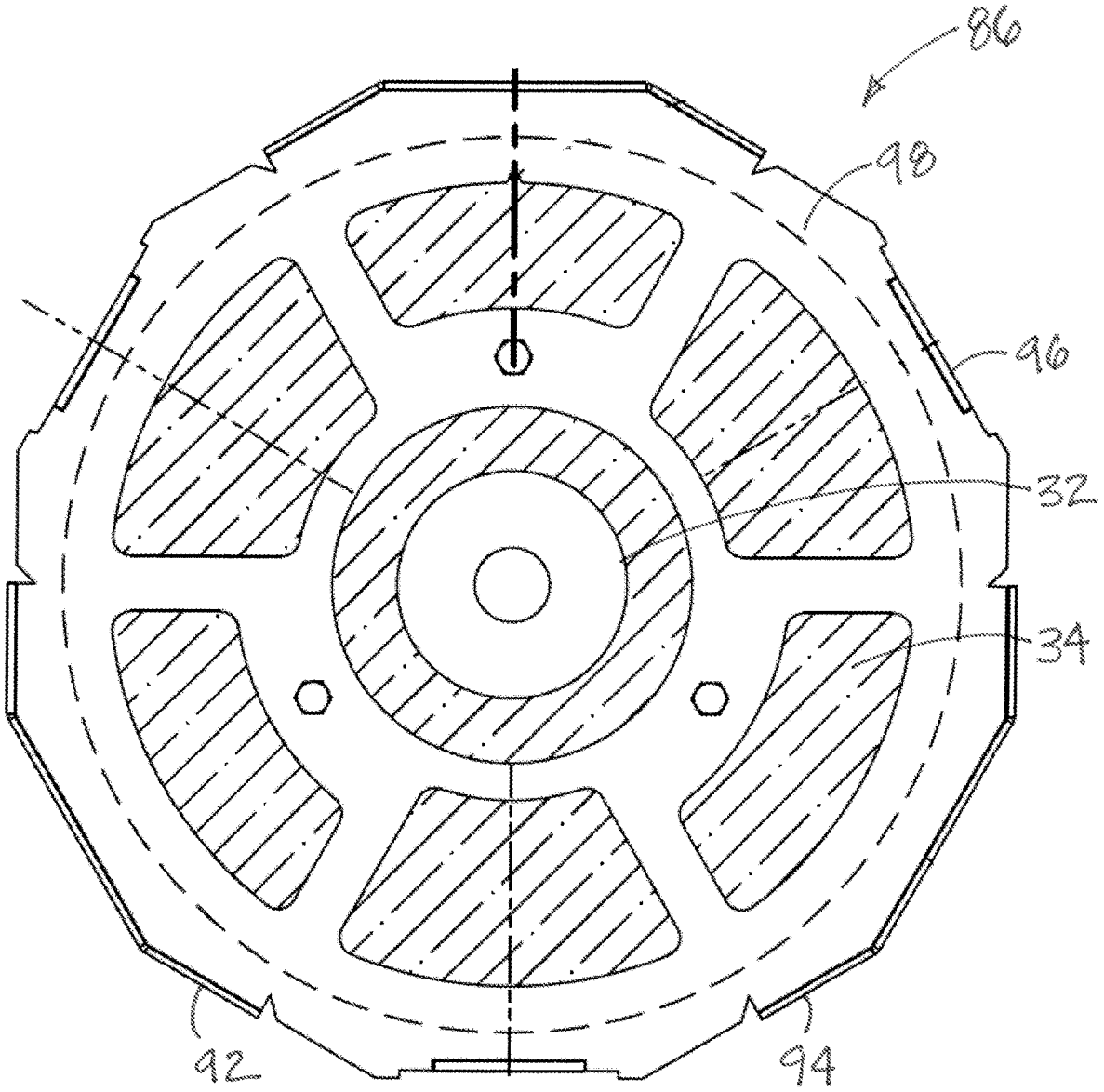
FIG. 4 is a schematic top view of aspects of the adapting frame structure of the concealment assembly with respect to the uppermost support of the antenna support assembly, according to an illustrative embodiment.
Figure 5:
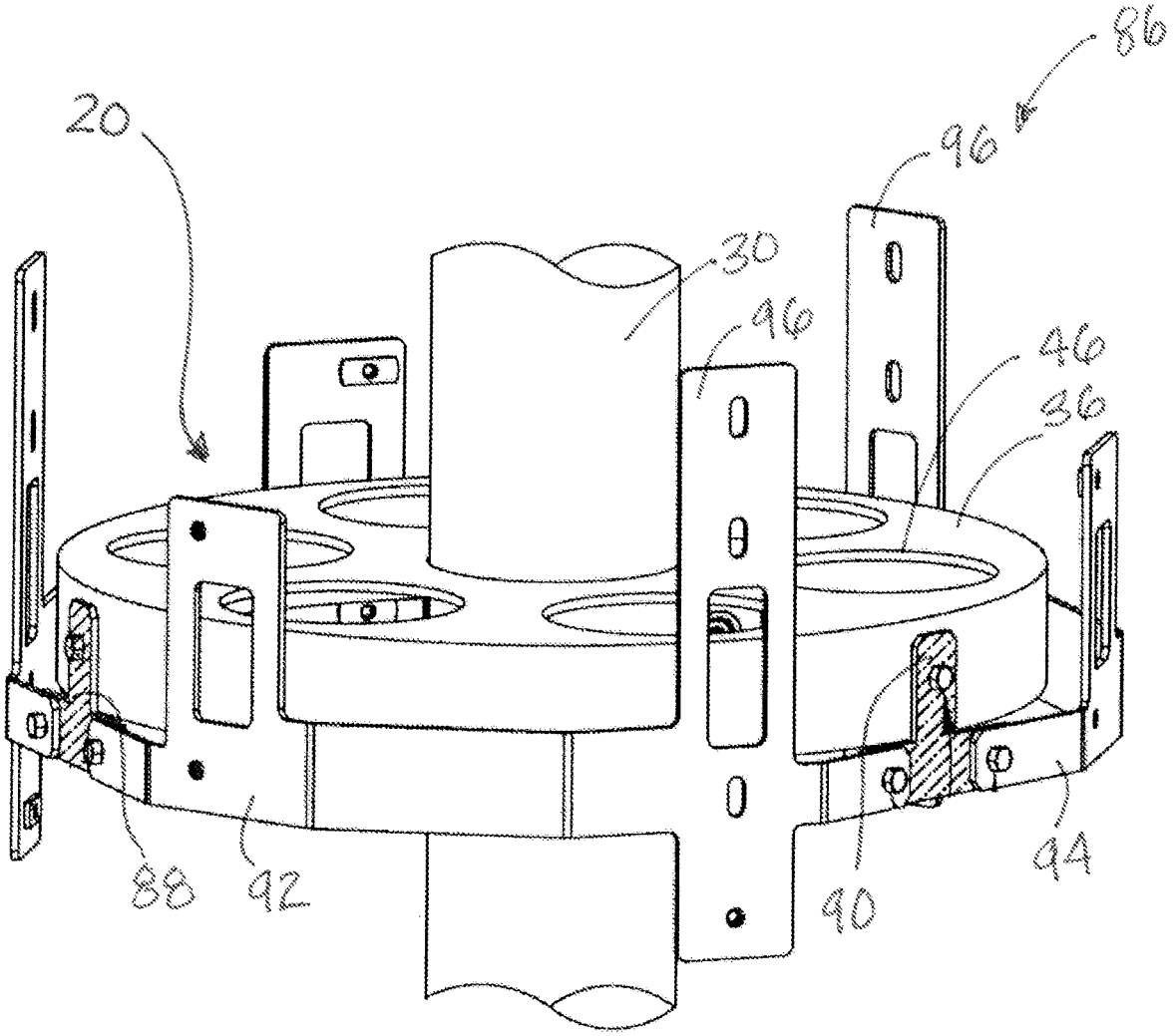
FIG. 5 is a schematic perspective view of aspects of the adapting frame structure of the concealment assembly with respect to a lowermost support of the antenna support assembly, according to an illustrative embodiment.
Figure 6:
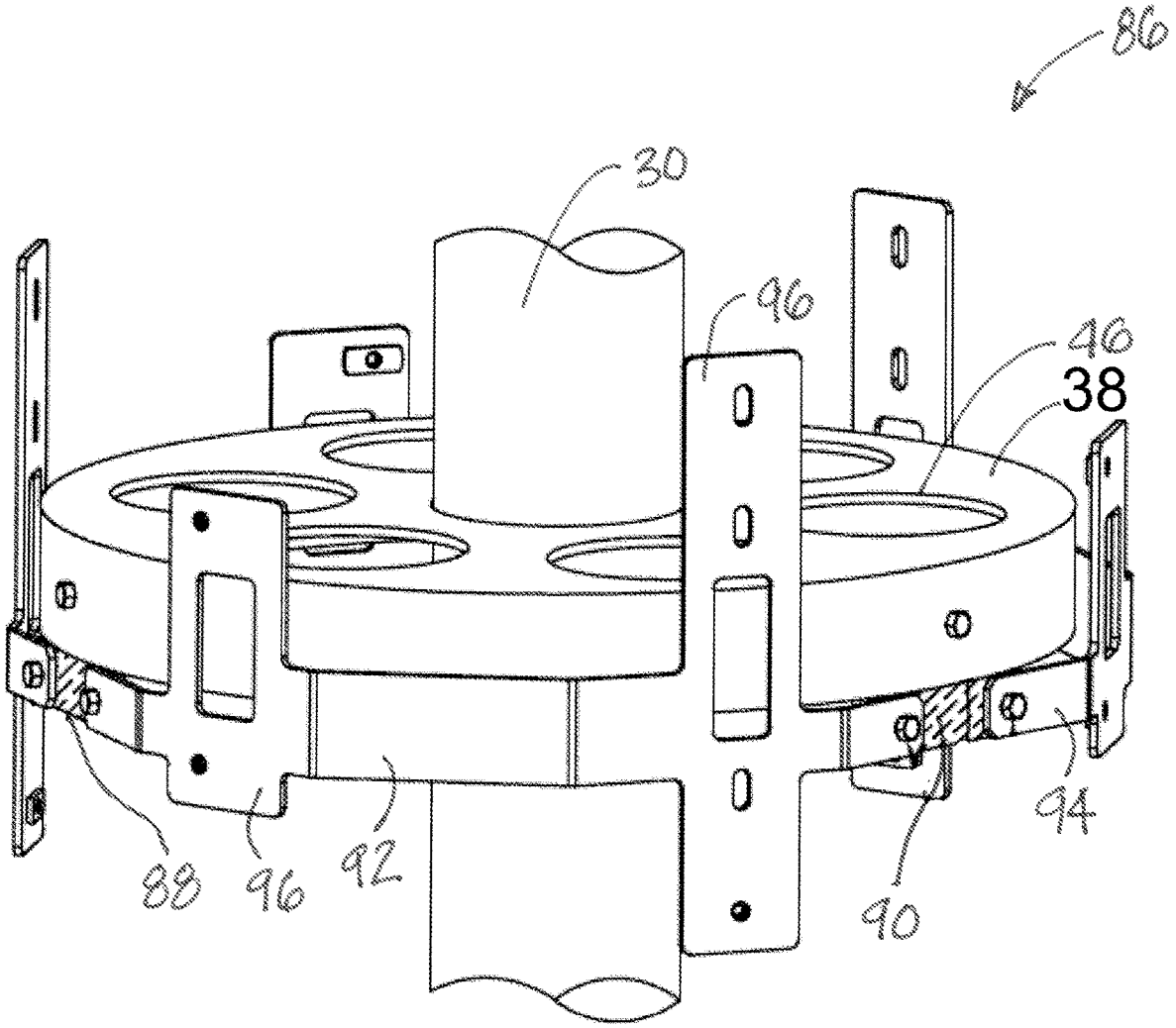
FIG. 6 is a schematic perspective view of aspects of the adapting frame structure of the concealment assembly with respect to an intermediate support of the antenna support assembly, according to an illustrative embodiment.
Figure 7:
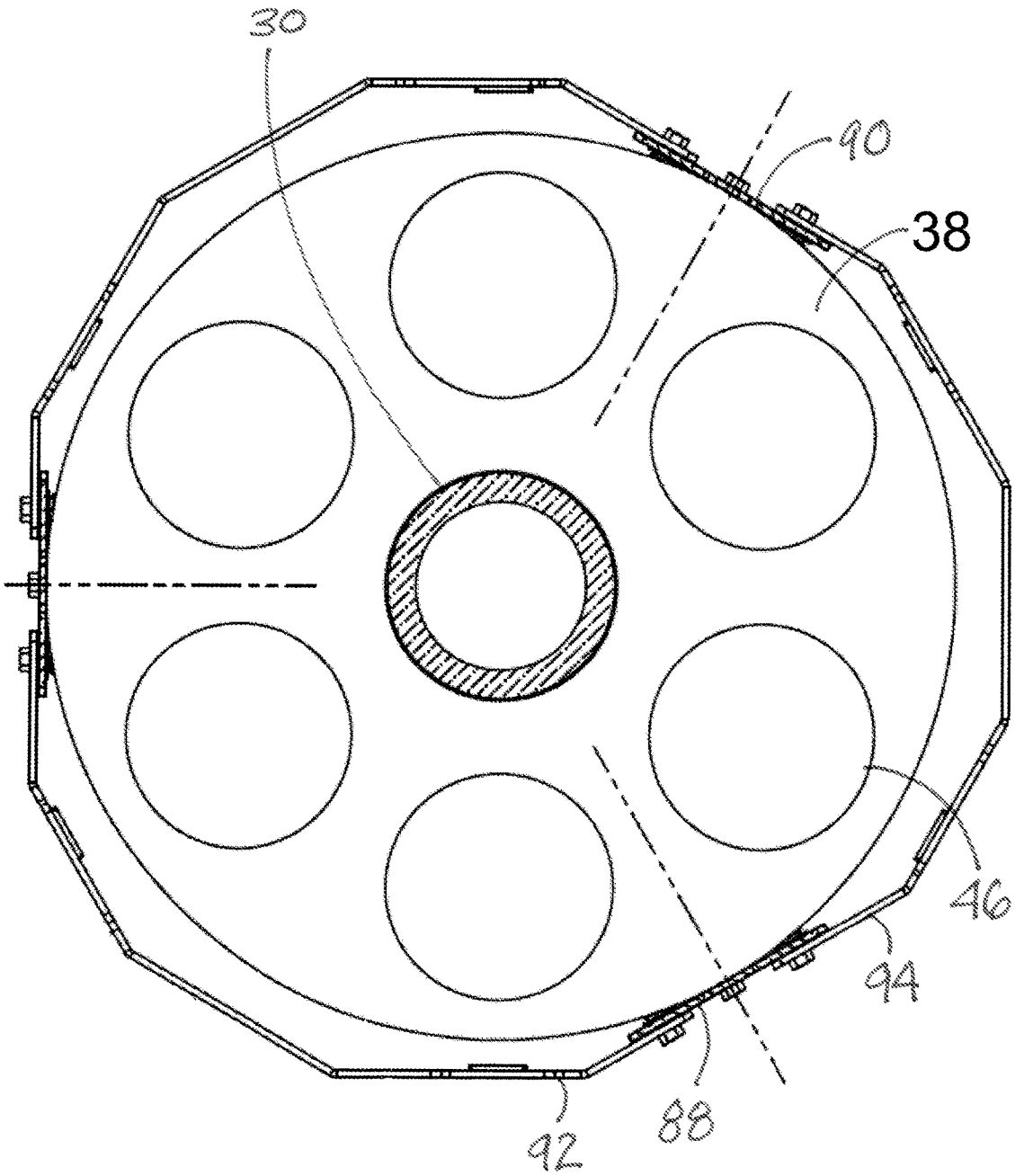
FIG. 7 is a schematic top view of aspects of the adapting frame structure of the concealment assembly with respect to the intermediate support of the antenna support assembly, according to an illustrative embodiment.
Figure 8:
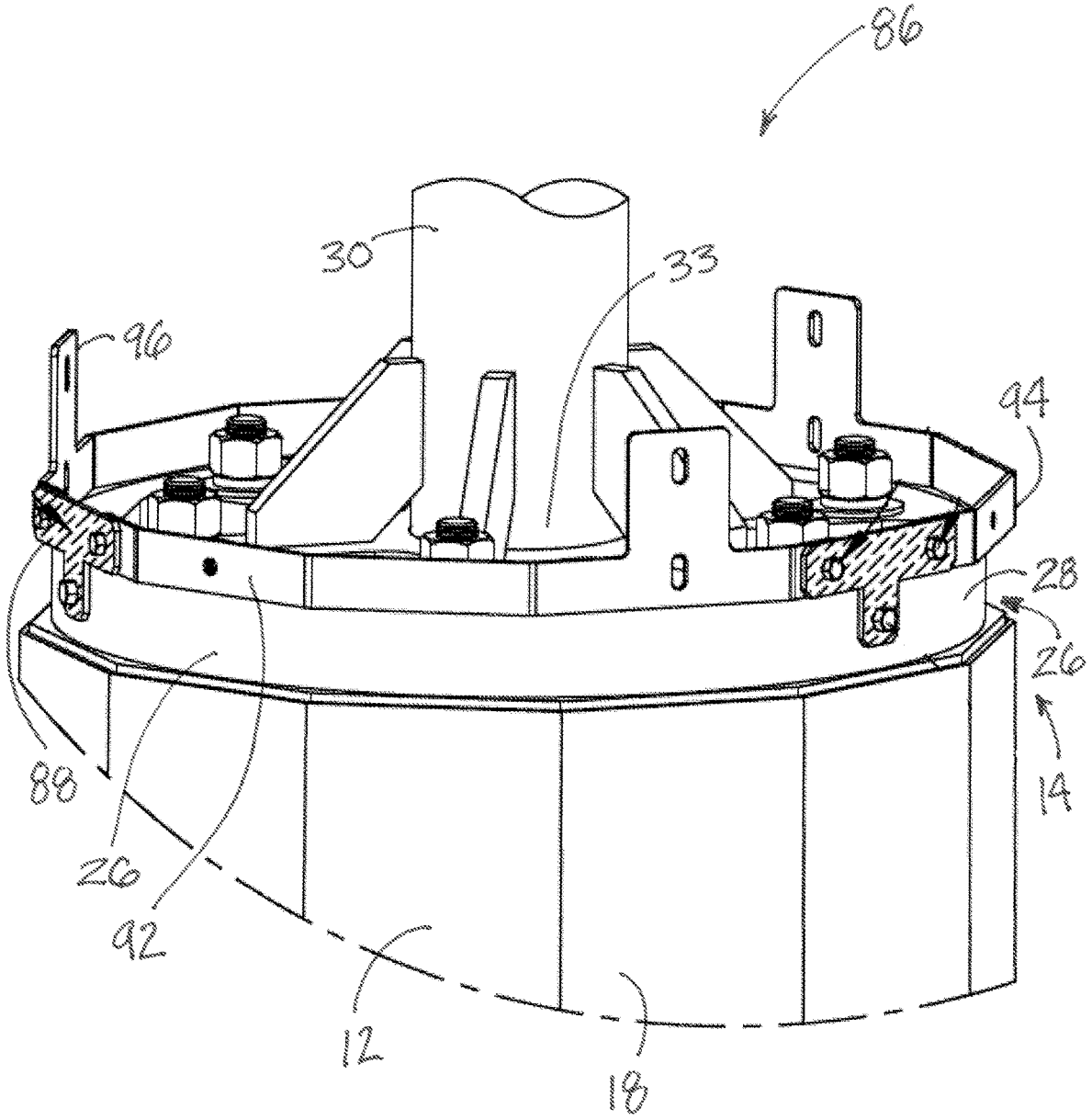
FIG. 8 is a schematic perspective view of aspects of the adapting frame structure of the concealment assembly with respect to the base of the antenna support assembly, according to an illustrative embodiment.
Figure 9:
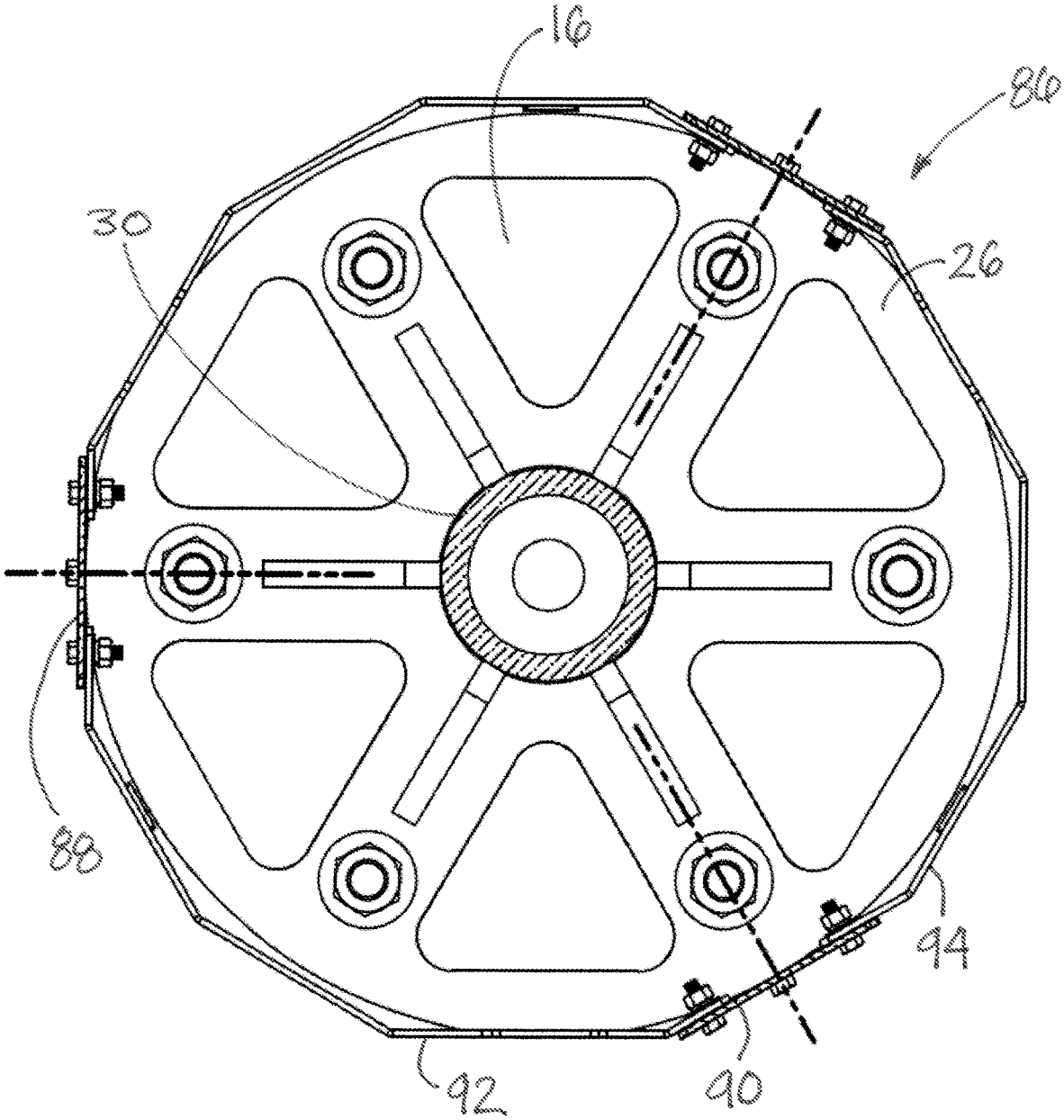
FIG. 9 is a schematic top view of aspects of the adapting frame structure of the concealment assembly with respect to the base of the antenna support assembly, according to an illustrative embodiment.
Figure 10:
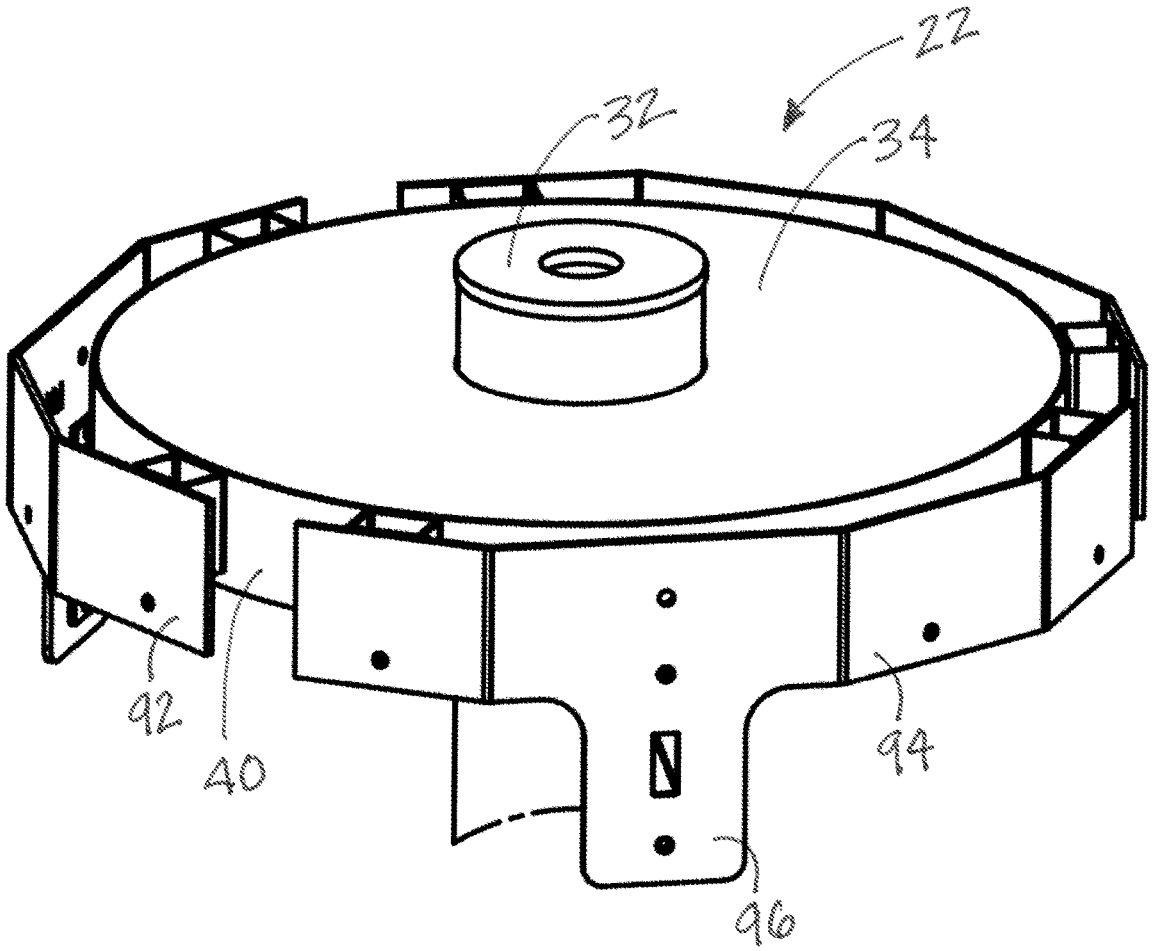
FIG. 10 is a schematic perspective view of aspects of the adapting frame structure of the concealment assembly including mounting arms with respect to the uppermost support of the antenna support assembly, according to an illustrative embodiment.
Figure 11:
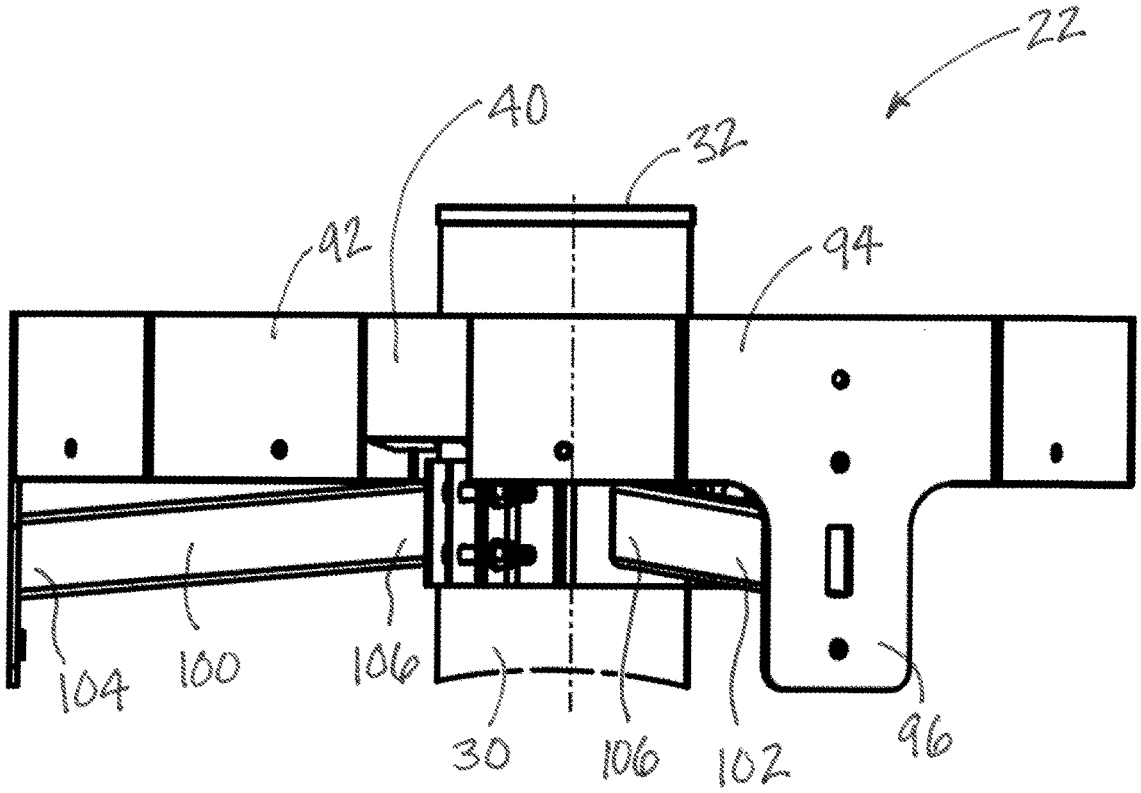
FIG. 11 is a schematic side view of aspects of the adapting frame structure of the concealment assembly including mounting arms with respect to the uppermost support of the antenna support assembly, according to an illustrative embodiment.
Figure 12:
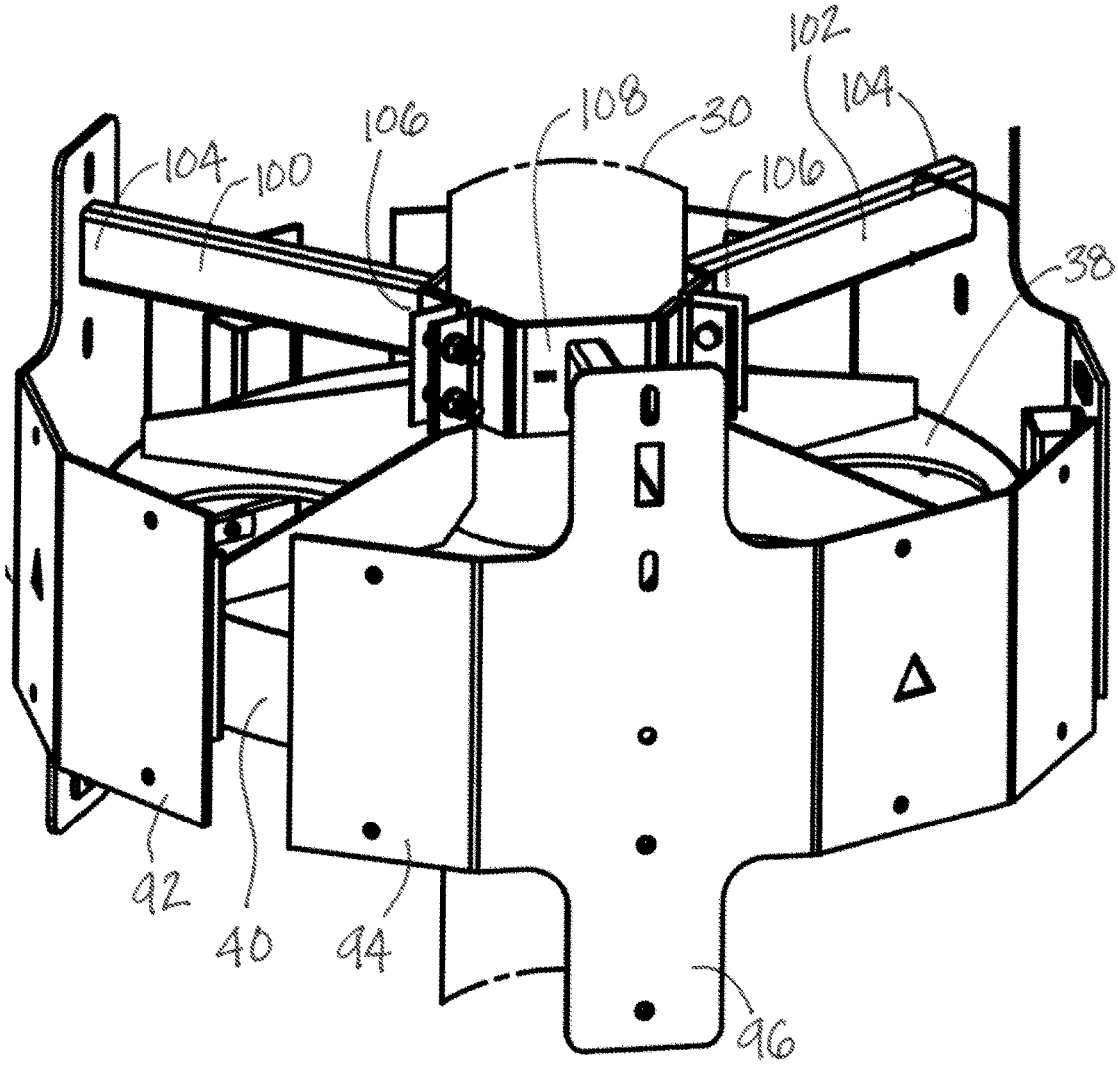
FIG. 12 is a schematic perspective view of aspects of the adapting frame structure of the concealment assembly including mounting arms with respect to the intermediate support of the antenna support assembly, according to an illustrative embodiment.
Figure 13:
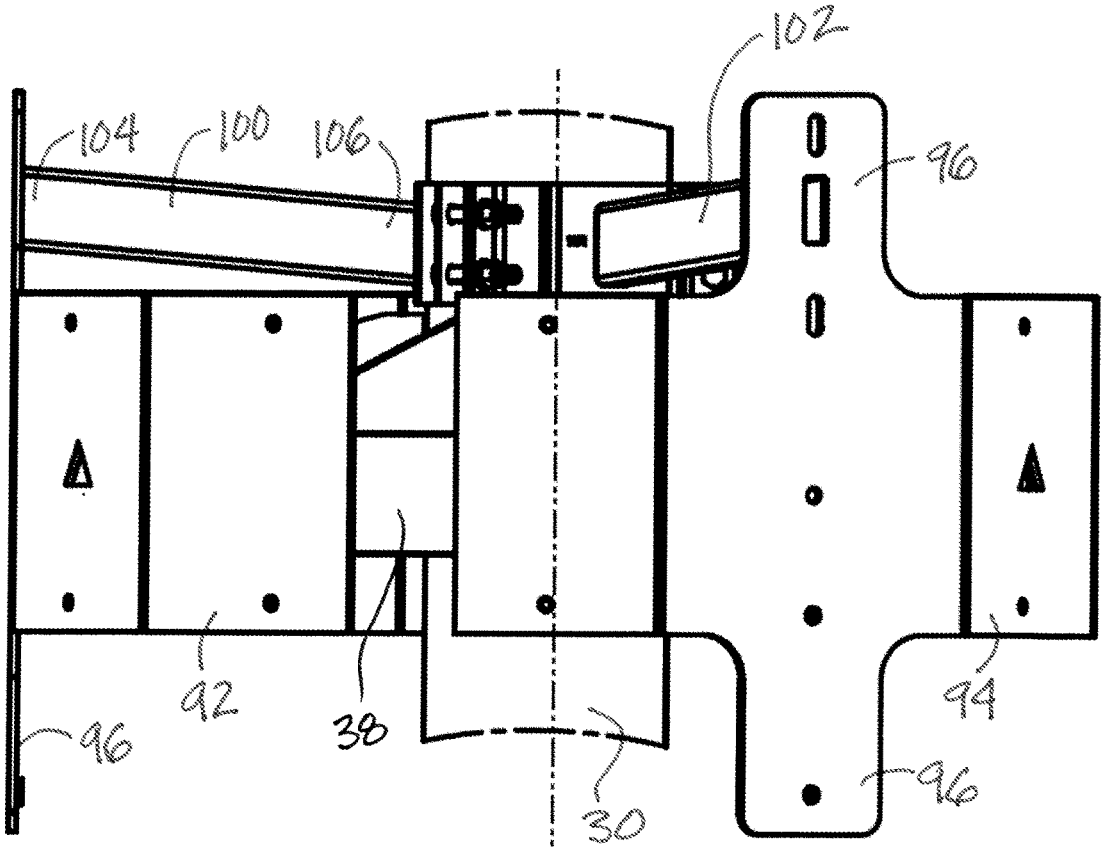
FIG. 13 is a schematic side view of aspects of the adapting frame structure of the concealment assembly including mounting arms with respect to the intermediate support of the antenna support assembly, according to an illustrative embodiment.
Figure 14:
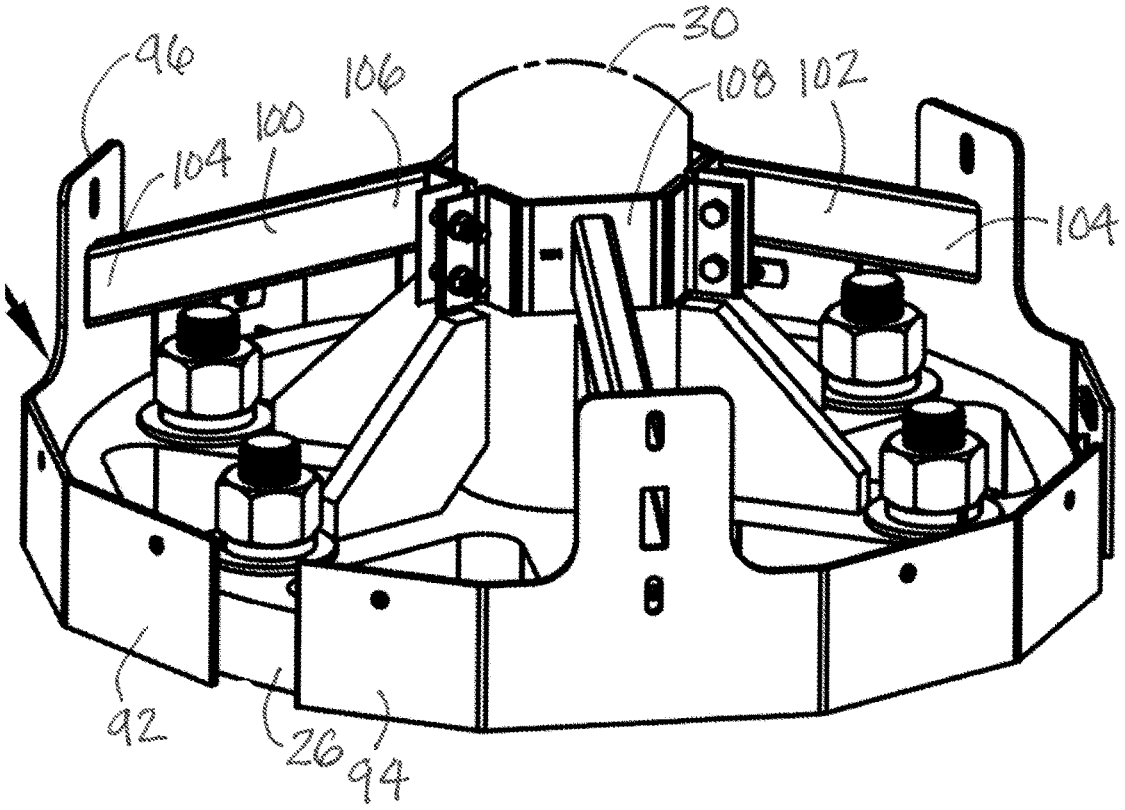
FIG. 14 is a schematic perspective view of aspects of the adapting frame structure of the concealment assembly including mounting arms with respect to the base of the antenna support assembly, according to an illustrative embodiment.
Figure 15:
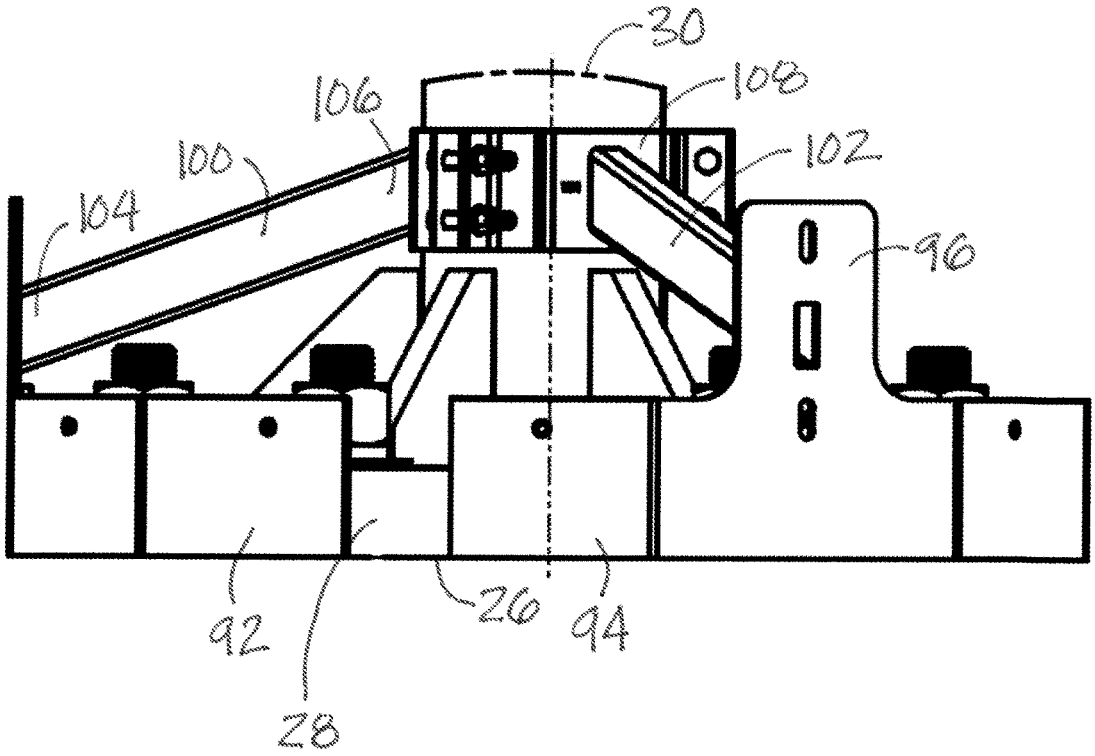
FIG. 15 is a schematic side view of aspects of the adapting frame structure of the concealment assembly including mounting arms with respect to the base of the antenna support assembly, according to an illustrative embodiment.
Figure 16:
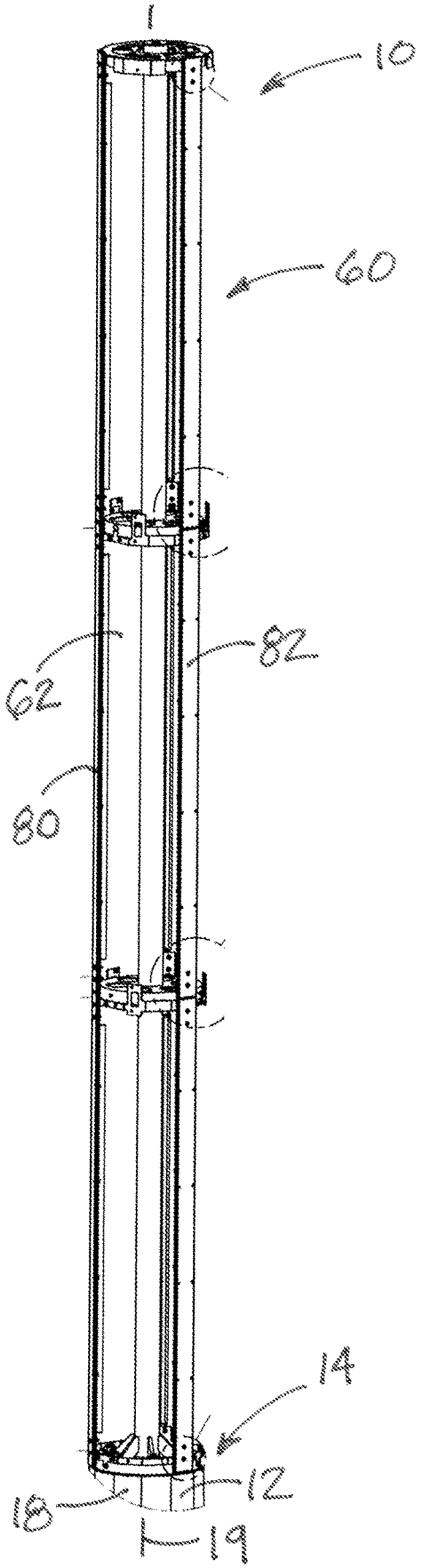
FIG. 16 is a schematic perspective view of the concealment assembly with one of the concealment panels removed to reveal detail, according to an illustrative embodiment.
Figure 17:
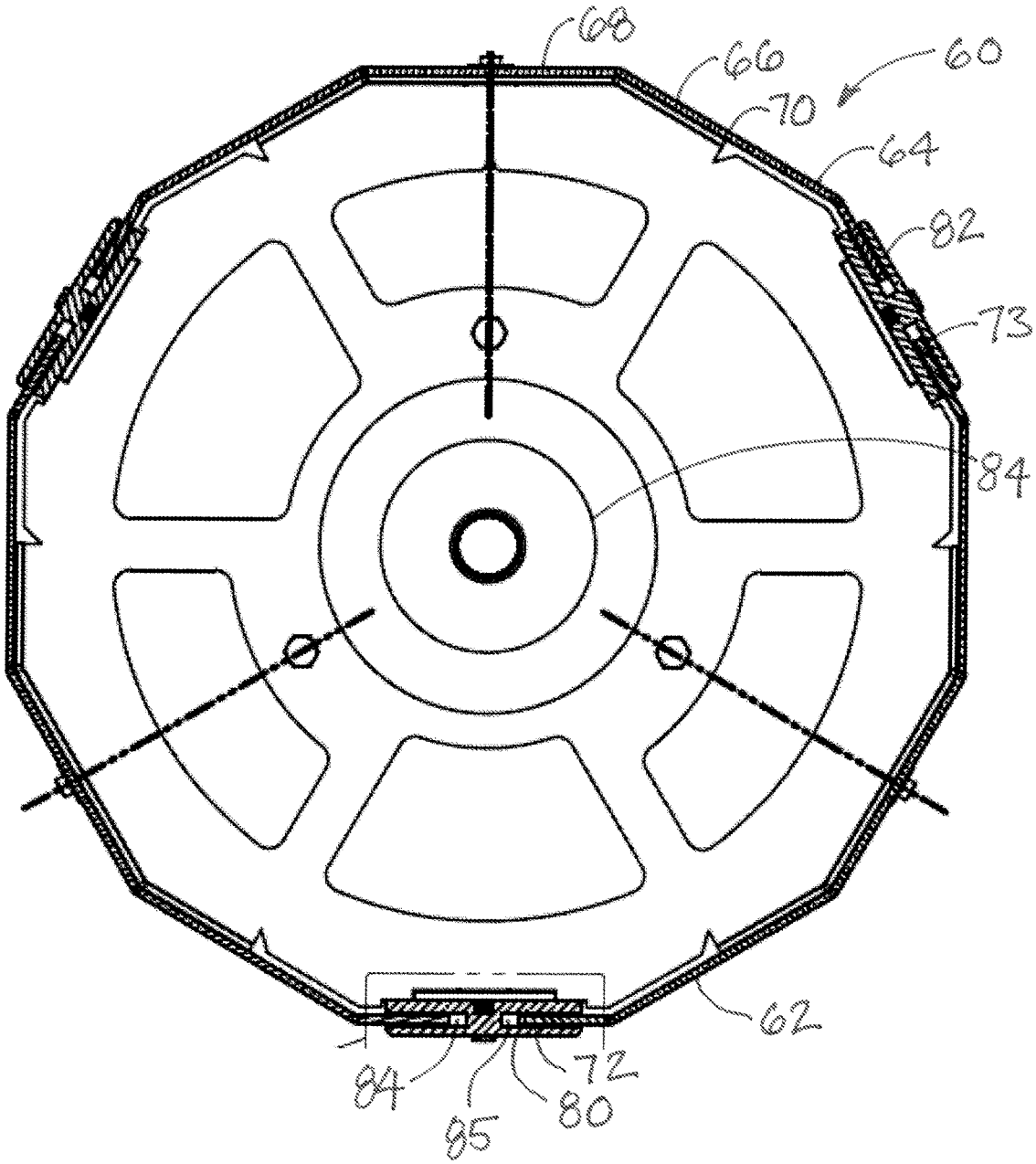
FIG. 17 is a schematic top sectional view of the concealment assembly with concealment panels and joiner panels shown with respect to the support assembly, according to an illustrative embodiment.
Figure 18:
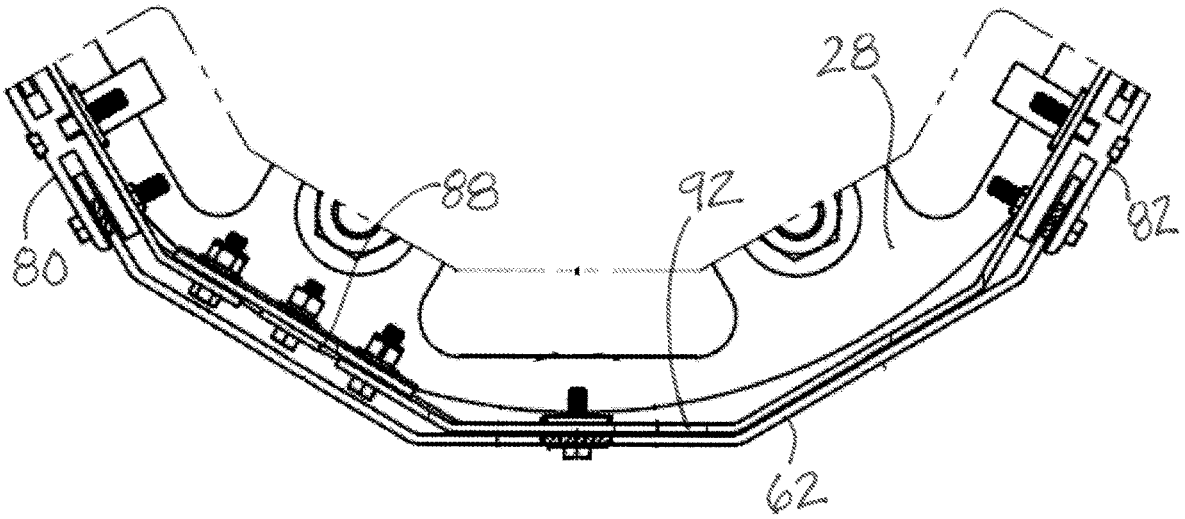
FIG. 18 is a schematic top sectional view of a portion of a support of the support assembly shown with a concealment panel and elements of the adapting frame structure of the concealment assembly, according to an illustrative embodiment.
Figure 19:
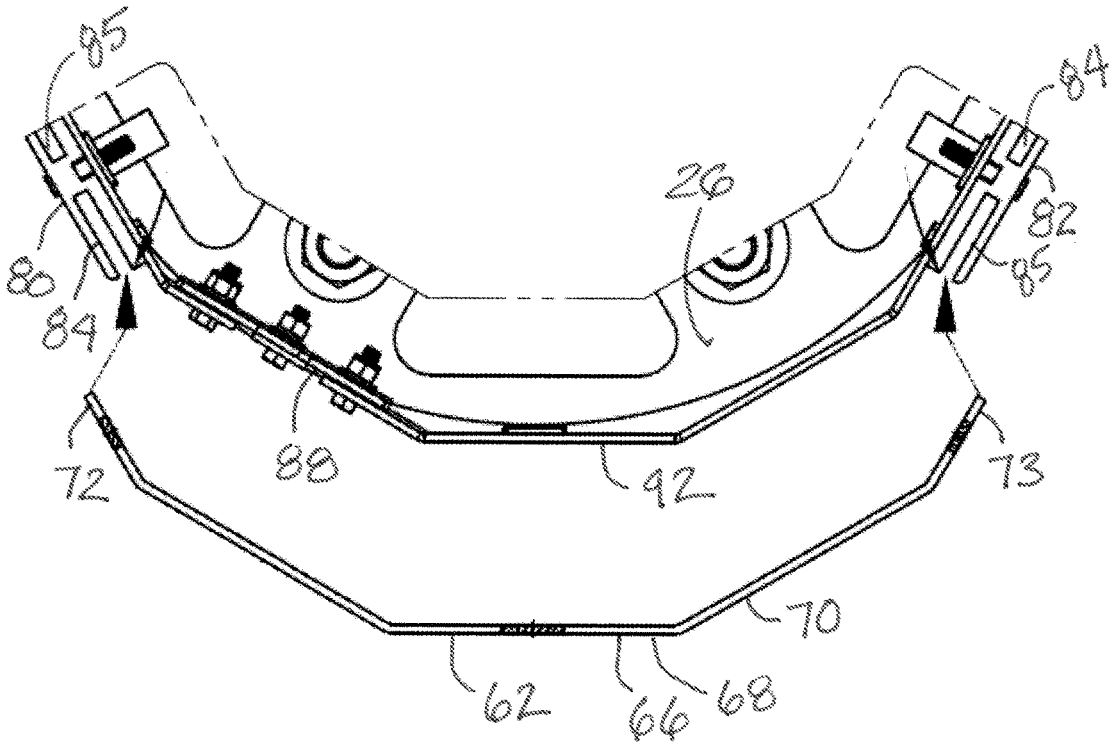
FIG. 19 is a schematic top sectional view of a portion of a support of the support assembly shown with a concealment panel shown in exploded relationship with respect to elements of the adapting frame structure of the concealment assembly, according to an illustrative embodiment.
Figure 20:
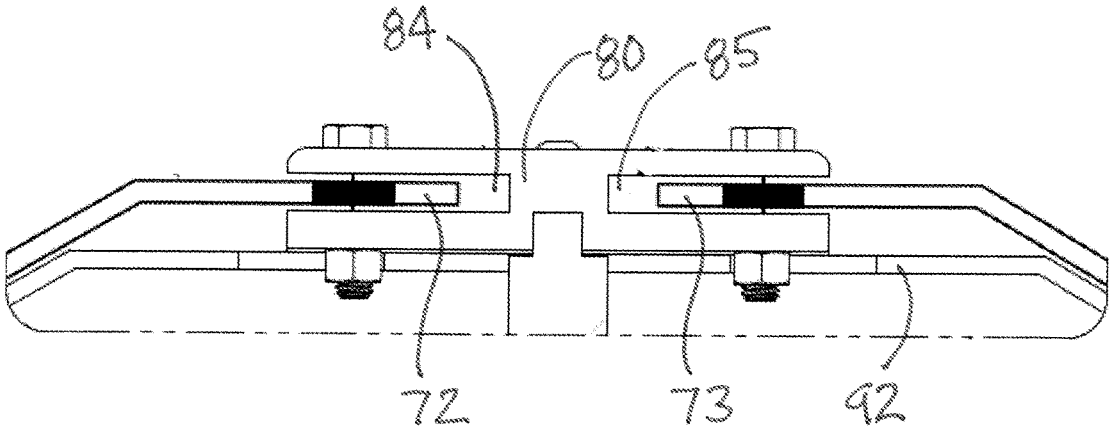
FIG. 20 is a schematic top sectional view of a portion of the concealment assembly including portions of the adjacent concealment panels and a joiner panel therebetween, according to an illustrative embodiment.
Figure 21:
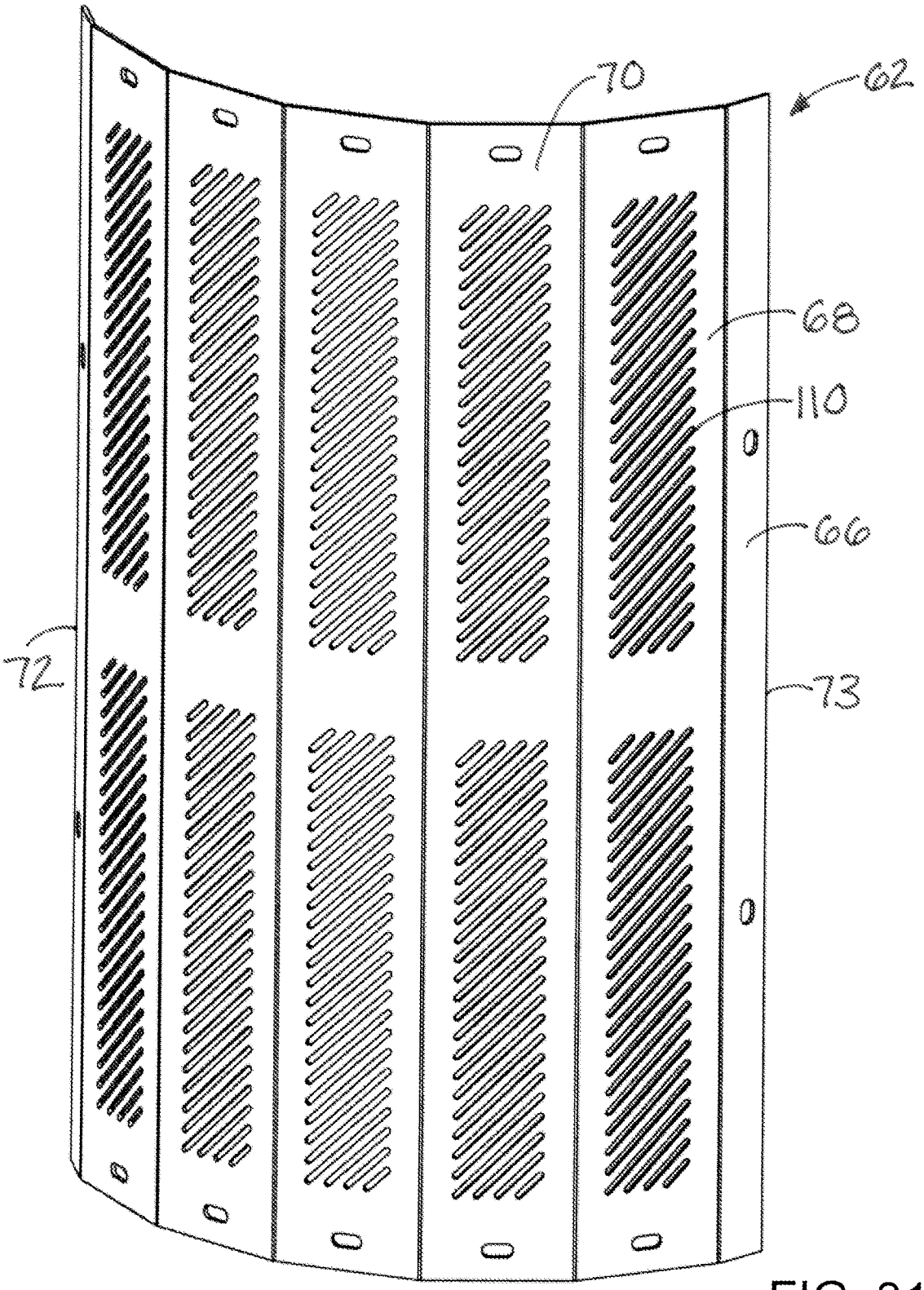
FIG. 21 is a schematic perspective view of a concealment panel of the concealment assembly isolated from other elements of the ventilated concealment system, according to an illustrative embodiment.

With reference now to the drawings, and in particular to FIGS. 1 through 25 thereof, a new ventilated concealment system for antenna transmission components on a tower embodying the principles and concepts of the disclosed subject matter will be described.

Antenna towers, and in particular cellular telephone signal transmission antenna towers, can pose aesthetic challenges in some environments, such as park areas and urban areas with residential housing to name a few examples. Towers formed of metal trusses capped by a multitude of protruding antennas may not fit the aesthetic of every location where it is desired to place a transmission tower. The proliferation of cellular telephone antenna towers to increase the geographic coverage for a seemingly ever-increasing number of cellular telephones (and other devices utilizing cellular telephone lines) has caused tower locations to be chosen which would otherwise not be selected for locating an antenna due to aesthetic concerns.

One approach to improve the aesthetics of the tower and the associated antennas has been to form the tower of a single monolithic pole with few, if any, appendages such that the tower and antennas resemble, for example, a large flagpole or even a tree, if provided with simulated branches and foliage. Such installations are made possible by positioning the transmission antennas in a relatively close pack to each other within a "canister" positioned at the top of the pole. The canister effectively conceals the antennas as well as the structure supporting the antennas, and includes concealment panels which are typically visually opaque but highly transparent to the signal transmission waves traveling to and from the antennas enclosed within the canister. As the antennas themselves generate relatively little, if any, heat, the enclosure of the antennas within the concealment canister has heretofore presented no problem regarding the air temperature within the canister.

However, the applicants have recognized that a recent practice directed toward increasing the operational efficiency of the transmission equipment has been to position not only the antennas, but also some of the signal handling equipment such as transmitters, at the top of the pole and in the concealment canister. The applicants have further recognized that this approach potentially presents the problem of overheating the equipment due to the close proximity of the equipment required to maintain the relatively thin and uncluttered profile of the tower.

To help alleviate this potential problem, the applicants have devised a system for providing ventilation to the signal handling equipment in the canister while maintaining visual obstruction of the antennas and equipment located at the top of the pole. The applicants have further developed a system and method for applying such a solution not only to towers being newly manufactured and installed, but also to retrofit existing towers with a canister structure having the improved ventilation benefits provided by the system.

In one aspect, the disclosure relates to a transmission antenna system 10 which may comprise a monopole and may be utilized, for example, to transmit wireless signals such as (but not limited to) cellular telephone signals. The system 10 may include a tower which is mounted on and extends substantially vertically upwardly from a surface, which is typically the ground surface but may comprise a surface on a structure such as a building structure.

The system 10 may include an elongated upstanding main pole 12 which is typically freestanding without guys or other external supports for the pole other than the mounting at the bottom of the pole. The main pole 12 has an apex 14 and may have an apex surface 16 located at the apex, and peripheral surface 18 of the main pole may extend downwardly from the apex surface. The main pole may define a longitudinal axis 19 which is typically oriented substantially vertically with respect to the ground surface, and the apex surface may be oriented substantially perpendicular to the axis 19 while the peripheral surface 18 may be oriented substantially parallel to the axis 19.

Another aspect of the system 10 may be an antenna support assembly 20 which may extend upwardly from the main pole 12, such as from the apex 14 of the pole. The support assembly 20 may have a top 22 and a bottom 23, and the bottom of the assembly may be mounted on the apex of the main pole. Illustrative embodiments of the antenna support assembly 20 may include a base 26 which is mounted on the apex of the main pole, and may rest upon the apex surface 16 of the pole. Suitable fasteners may be utilized to connect the base to the apex. The base 26 may extend laterally with respect to the longitudinal axis 19 of the main pole and may have a base perimeter surface 28 located radially outwardly from the axis 19 and may have a substantially cylindrical shape which may be similar in size, but somewhat smaller than, the peripheral surface 18 of the pole 12 at the apex 14. The antenna support assembly 20 may also include a mast 30 which is mounted on and extends upwardly from the base 26. The mast may have an upper end 32 and a lower end 33, and the distance between the ends 32, 33 may define a length of the mast. The lower end 33 of the mast may be united to the base 26 and the mast may be substantially centered on the longitudinal axis 19 to effectively form a central spine for the support assembly 20.

The antenna support assembly 20 may also include a plurality of supports 34, 36, 38 which are mounted on the mast at spaced locations along the length of the mast. Each of the supports may have a support perimeter surface 40 which may have a substantially cylindrical shape. A perimeter wall 42 of the support may form the support perimeter surface, and a support plate 44 may extend outwardly from the mast 30 to the perimeter wall 42 such that the wall 42 is mounted on the support plate 44 and is thus mounted on the mast. Each of the support plates 44 may have at least one antenna aperture 46 with the aperture in the support plate of one support being substantially vertically aligned with the antenna aperture in support plate of another support located above and below the first support plate. Typically, each of the support plates may have a plurality of the antenna apertures such that a plurality of antennas may be supported on the support assembly 20. Illustratively, the plurality of supports may include an uppermost support 34 which may be positioned toward or at the upper end 32 of the mast, a lowermost support 36 which is positioned toward or at the lower and 33 of the mast, and one or more intermediate supports 38 positioned between the uppermost 34 and lowermost 36 supports. Usually the intermediate supports may be substantially uniformly spaced from each other and from the uppermost and lowermost supports.

The system 10 may also include at least one antenna 50 which is mounted on the antenna support assembly 20 and may be mounted on at least one, and typically more than one, of the supports 34, 36, 38. An antenna may extend through the antenna aperture or apertures of one or more of the support plates. At least one transmitter 52 which is configured to transmit the signal wirelessly via the antenna 50 may also be mounted on the antenna support assembly, or in close proximity to the antenna, such that the transmitter 52 is able to be positioned within the concealment assembly disclosed herein.

The system 10 may also include a concealment assembly 60 which is mounted on the antenna support assembly for concealing from external view the antenna support assembly, the one or more antennas mounted on the antenna support assembly, and the one or more transmitters. The concealment assembly 60 may effectively form a canister or container enclosing these elements.

The concealment assembly 60 may include a plurality of concealment panels 62, 64 which may be supported on the antenna support assembly 20. As examples, in some embodiments elements of the assembly 60 may be supported on the supports 34, 36, 38, while in other embodiments elements of the assembly 60 may be supported on the mast 30. The plurality of concealment panels may be positioned in an array about the support assembly 20 in a manner that substantially blocks viewing of the support assembly, antennas, and transmitters from an exterior of the tower. Each of the concealment panels may have an outer surface 66, and the outer surfaces of the panels may collectively form a visual extension of the peripheral surface 18 of the main pole. In some embodiments, the outer surface 66 of a concealment panel may have a plurality of substantially planar sections 68, 70 to provide a multifaceted surface. The concealment panels may be elongated and may extend at least the distance between adjacent supports 34, 36, 38, and in some implementations may extend between multiple supports of the support assembly 20. Each of the substantially planar sections 68, 70 may extend substantially the entire length of the panel, and the panel may be bounded by elongated side edges 72, 73 that also extend the length of the panel. The panels may be formed of any material suitably transparent to permit wireless signals from the antennas to propagate through the panels without significant losses in signal strength.

The concealment assembly 60 may also include a plurality of joiner panels 80, 82 which are configured to join adjacent concealment panels together and may effectively complete the enclosure of the canister. In some embodiments, each joiner panel 80, 82 may be configured to receive on the adjacent side edges of adjacent concealment panels, and may be provided with a pair of opposite slots 84, 85 extending along the length of the joiner panel slot to receive portions of the concealment panels located adjacent to the side edges. The slots 84, 85 may have sufficient depth to permit for expansion and contraction of the panels under varying environmental conditions.

The concealment assembly 60 may also include an adapting frame structure 86 which is configured to mount the concealment panels on the antenna support assembly 20, and may also mount the joiner panels to the assembly 20.

In some embodiments, such as shown in FIGS. 5 through 9, the adapting frame structure 86 may include a plurality of brackets mountable on at least one support, and usually a plurality of the supports. The plurality of brackets may form a support perimeter 92, and support perimeter may be polygonal in shape which is different from the circular shape of the support perimeter surface 40 of the supports and the base perimeter surface 28 of the base 26. The plurality of brackets may include at least one mounting bracket 88 mounted on at least one of the supports, and may include a plurality of the mounting brackets 88, 90. Each of the supports may have multiple mounting brackets mounted thereon, and illustratively a set of three mounting brackets may be mounted on the support. Each of the mounting brackets may be fastened to a support, and illustratively the mounting bracket may be substantially planar in shape.

The plurality of brackets may also include at least one connecting bracket mounted on the one or more mounting brackets associated with a support. Typically, a plurality of the connecting brackets 92, 94 is utilized with each of the connecting brackets extending between at least two of the mounting brackets 88, 90. Each connecting bracket may be fastened on each end to one of the mounting brackets. Illustratively, a set of three connecting brackets may be associated with the mounting brackets mounted on a single support.

The connecting brackets may be bent into a series of segments in which each of the segments is substantially planar but is angled with respect to an adjacent segment to permit the connecting bracket to be positioned adjacent to an inner surface of a corresponding concealment panel. Some embodiments of the connecting brackets may include at least one connecting tab 96 for connecting to a concealment panel. Illustratively, a connecting tab 96 may extend upwardly and downwardly from the main portion of the connecting bracket so that a panel of a relatively lower array of panels may be fastened to the a lower portion of the tab and a panel of a relatively higher array of panels of the concealment assembly may also be fastened to an upper portion of the tab. For some applications, such as at the uppermost support 34, the connecting brackets may be unified together by a connecting web frame 98 which rests upon the uppermost support and supports the connecting brackets 92, 94 and connecting tab 96 in a position on the support 34 adjacent to the perimeter surface 40 of the support.

In embodiments, such as shown in FIGS. 10 through 15, the adapting frame structure 86 may include a plurality of mounting arms 100, 102 which are mounted on the mast 30 of the support assembly 20 and extend radially outwardly from the mast. The connecting brackets may be mounted on the outer ends 104 of the arms 100, 102 to support the connecting brackets on the mast.

A set of the mounting arms may be located on the mast at substantially the same vertical level above the main pole, and a plurality of the sets of the mounting arms may be utilized with each set being located at a relatively different vertical level above the main pole. In some embodiments, each set may be located adjacent to one of the supports of the support assembly although direct connection to the respective support may not be utilized. Inner ends 106 of the mounting arms may be linked together to form a perimeter band 108 which extends about the mast to be constricted to thereby grip the mast and support the arms on the mast, as well as the connecting brackets and the panels connected to the arms.

Significantly, at least one of the concealment panels 62, 64 may include at least one ventilation slot 110 to permit environmental (and often cooler) air to effectively move through the panel from the exterior of the concealment assembly to the interior of the concealment assembly, and conversely permit (often warmer) air from the interior of the concealment assembly to move through the panel to the exterior of the concealment assembly.

Depending upon the degree of cooling required, and thus the amount of air needed to be passed through the concealment assembly, the quantities and locations of the ventilation slots may be varied. For example, more than one of the concealment panels of the assembly 60 may have a ventilation slot, and each of the panels may have a plurality of ventilation slots. Ventilation slots may be formed in each of the planar sections of a panel, or in alternating or non-adjacent sections of the panel, as well as in alternating panels. Further, the ventilation slots may have various orientations with respect to the vertical, such as substantially vertical or substantially horizontal. In some embodiments, the slots may have an inclined orientation such as, for example, oriented at approximately 45 degrees with respect to the vertical.

Figure 22:
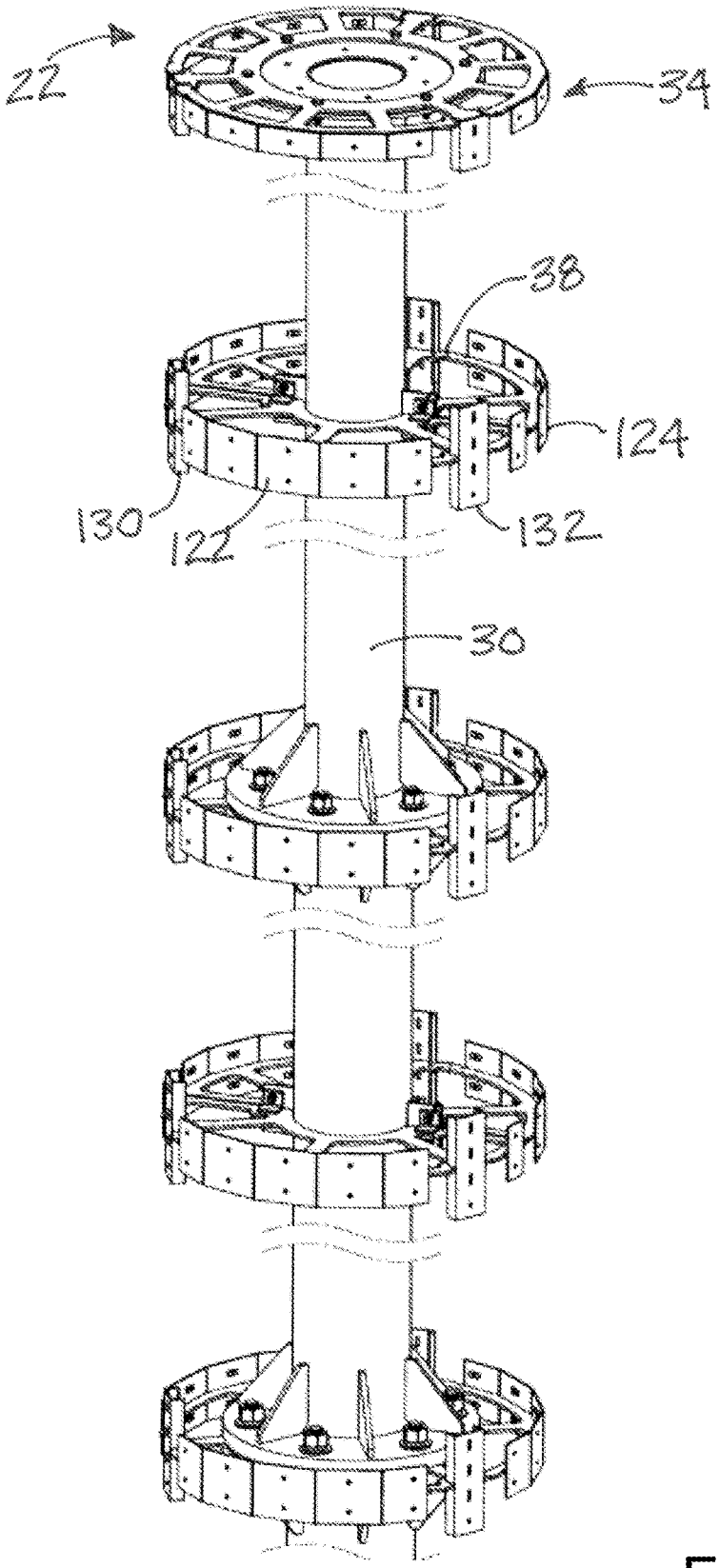
FIG. 22 is a schematic perspective view of a portion of an antenna support assembly with portions of an optional concealment assembly, according to an illustrative embodiment.
Figure 23:
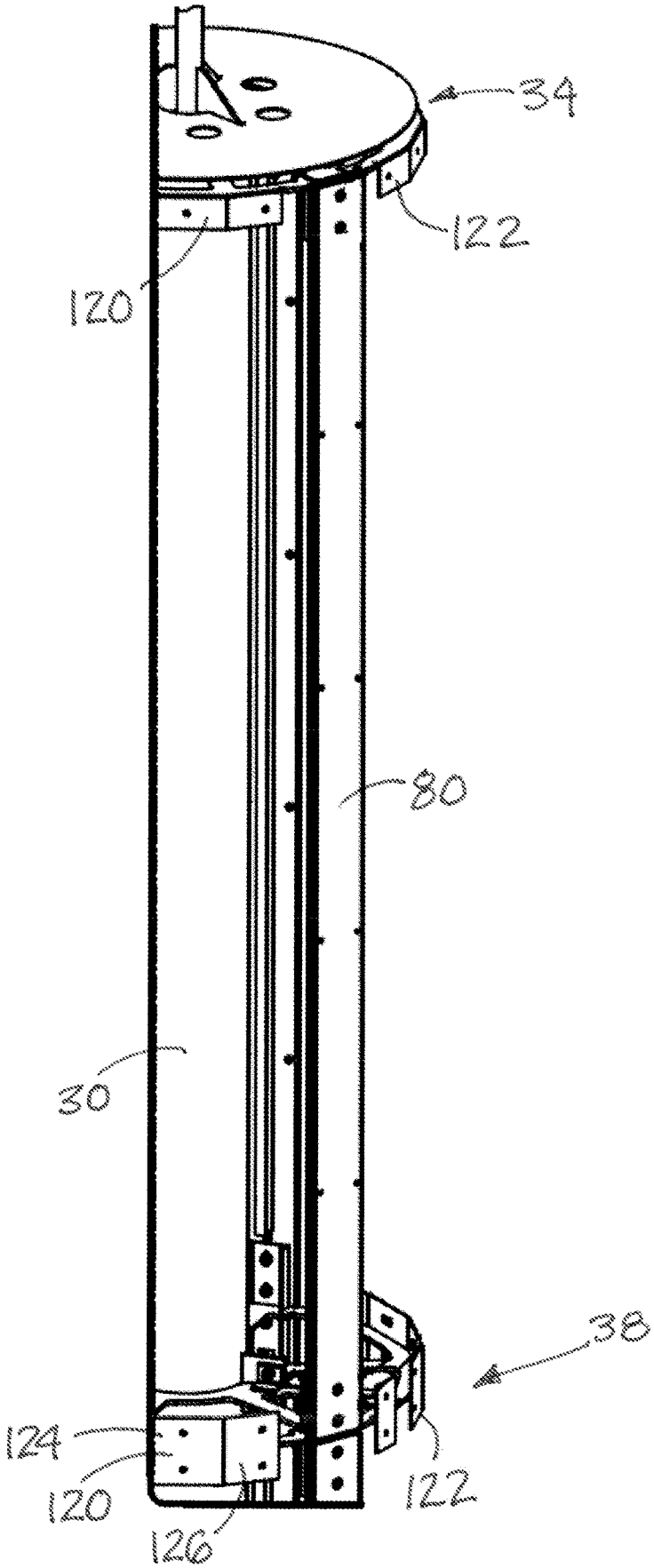
FIG. 23 is a schematic perspective view of a portion of the antenna support assembly with portions of the optional concealment assembly shown in FIG. 22, according to an illustrative embodiment.
Figure 24:
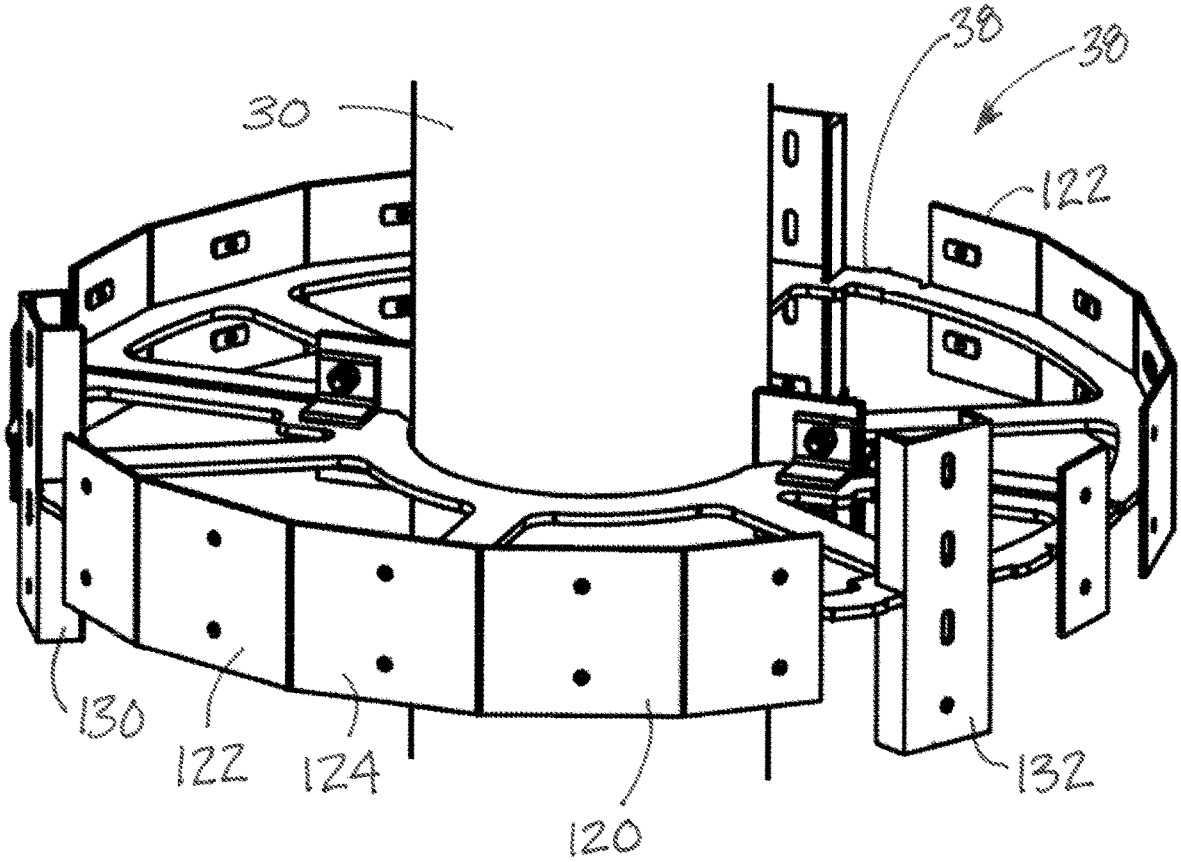
FIG. 24 is a schematic perspective view of a portion of the antenna support assembly with portions of the optional concealment assembly, according to an illustrative embodiment.
Figure 25:
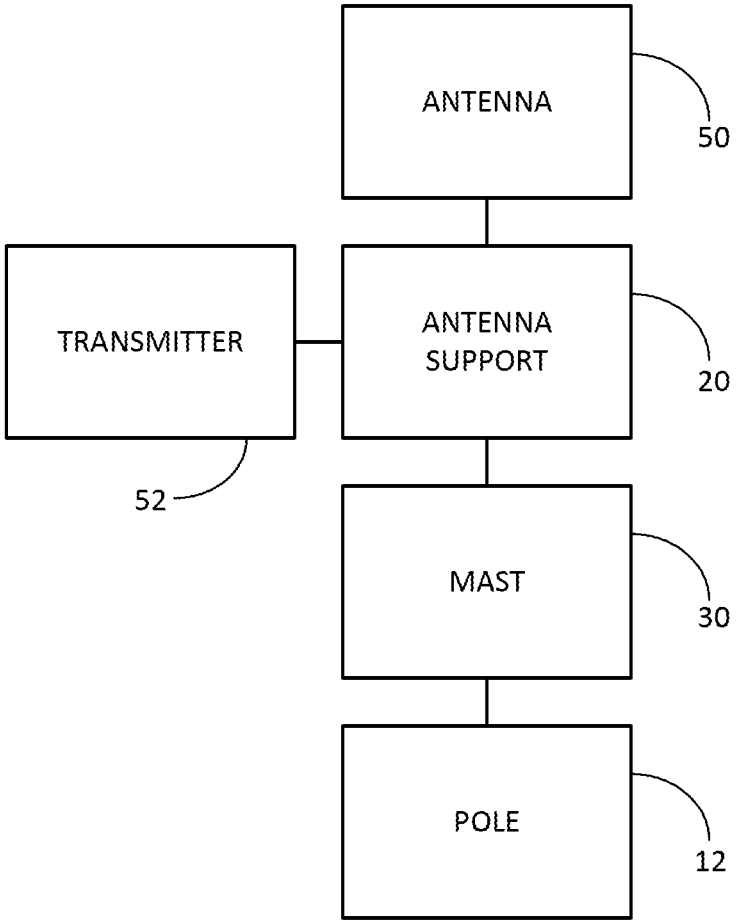
FIG. 25 is a schematic block diagram of elements of the system, according to an illustrative embodiment.

Optional embodiments of the adapting frame structure 86, such as shown in FIGS. 22 through 24, may include at least one concealment panel bracket 120 mounted on one of the supports 34, 36, 38 and which is configured to mount one of the concealment panels to the respective support. In some embodiments, a plurality of the concealment panel brackets 120, 122 may be positioned along the perimeter of the support. Some embodiments of the concealment panel brackets have a plurality of panel bracket sections 124, 126 with each of the sections 124, 126 being oriented nonparallel to each other, such as in planes that are somewhat angled with respect to each other. Each concealment panel bracket may be elongated with the bracket sections being positioned next to each other in the direction of elongation of the bracket 120. Typically, the direction of elongation of the concealment panel bracket may be substantially horizontal when the concealment panel bracket is in use and mounted on a support of the antenna support assembly.

The optional embodiments of FIGS. 22 through 24 may also include at least one joiner panel bracket 130 mounted on one of the supports 34, 36, 38. The joiner panel bracket 130 may be configured to mount one of the joiner panels 80 to one of the supports 34, 36, 38. In some embodiments, a plurality of the joiner panel brackets 130, 132 may be mounted on one of the supports. The joiner panel brackets 130, 132 may be mounted on the respective support 34 at separated locations. The joiner panel brackets 130, 132 may each be positioned in a gap formed between adjacent concealment panel brackets 120, 122 on the support 34, 36, 38. The joiner panel brackets may be elongated, and the direction of elongation of the joiner panel bracket may be substantially vertical when the joiner panel bracket is in use and mounted on a support of the antenna support assembly.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A transmission antenna system comprising:

an elongate upstanding main pole;

an antenna support assembly extending upwardly from the main pole;

at least one antenna mounted on the antenna support assembly;

a concealment assembly mounted on the antenna support assembly and configured to conceal from view the antenna support assembly and the at least one antenna, the concealment assembly including:

a plurality of concealment panels positioned in an array about the antenna support assembly and the at least one antenna, at least one of the concealment panels having at least one ventilation slot therethrough; and wherein at least one of the concealment panels has an outer surface with a plurality of substantially planar sections each oriented at an oblique angle with respect to each other.

2. The system of claim 1 wherein the at least one ventilation slot includes a plurality of ventilation slots in the at least one concealment panel.

3. The system of claim 2 wherein the plurality of ventilation slots are positioned in sections of a said panel that alternate with sections lacking ventilation slots.

4. The system of claim 2 wherein the plurality of ventilation slots have an orientation inclined with respect to a vertical axis.

5. The system of claim 1 wherein a pair of the concealment panels each have at least one of the ventilation slots, the pair of concealment panels being located on substantially opposite locations in the array of concealment panels in the concealment assembly to permit a cross flow of air through the concealment assembly.

6. The system of claim 1 wherein each of the concealment panels has an outer surface and the outer surfaces of the concealment panels collectively form an upward extension of a peripheral surface of the main pole.

7. The system of claim 1 wherein at least one of the concealment panels of the concealment assembly includes a fold in material forming the concealment panel, the fold being located between adjacent substantially planar sections of the concealment panel to orient the substantially planar sections at the oblique angle with respect to each other.

8. The system of claim 1 wherein the antenna support assembly comprises:

a base mounted on an apex of the main pole and having a base perimeter surface;

a mast mounted on and extending upwardly from the base, the mast having an upper end and a lower end united to the base; and a plurality of supports mounted on the mast at spaced locations along the length of the mast, each of the supports having a support perimeter surface.

9. The system of claim 1 additionally comprising at least one transmitter configured to transmit a signal via the at least one antenna, the at least one transmitter being mounted on the antenna support assembly.

10. The system of claim 1 wherein the concealment assembly additionally includes a plurality of joiner panels configured to join together adjacent concealment panels in the array, each joiner panel having a pair of slots located on opposite sides of the joiner panel, adjacent side edges of the adjacent concealment panels being inserted into the pair of slots of the joiner panel.

11. A concealment assembly for mounting on a transmission antenna apparatus including an elongate upstanding main pole and an antenna support assembly extending upwardly from the main pole to conceal from view the antenna support assembly, the concealment assembly comprising:

a plurality of concealment panels positionable in an array about the antenna support assembly and at least one antenna, one or more of the plurality of concealment panels having a plurality of ventilation slots therethrough, each of the concealment panels being elongated with elongated side edges;

at least one joiner panel configured to join adjacent concealment panels, each joiner panel being configured to join adjacent side edges of the adjacent concealment panels;

an adapting frame structure configured to mount the concealment panels and the at least one joiner panel on the antenna support assembly;

wherein the at least one joiner panel has a pair of slots located on opposite sides of the at least one joiner panel; and wherein the at least one joiner panel is positioned between two adjacent concealment panels in the array and adjacent elongated side edges of the two adjacent concealment panels are inserted into the slots on the opposite sides of the at least one joiner panel.

12. The assembly of claim 11 wherein the at least one joiner panel comprises a plurality of the joiner panels with each joiner panel being positioned between two adjacent concealment panels in the array.

13. The assembly of claim 11 wherein the antenna support assembly includes a base mounted on an apex of the main pole, a mast extending upwardly from the base, and a plurality of supports mounted on the mast at spaced locations along the length of the mast; and wherein the adapting frame structure comprises a plurality of brackets mountable on each of the supports of the plurality of supports to form a support perimeter on which at least the joiner panels are mounted.

14. The assembly of claim 13 wherein the support perimeter is polygonal in shape in a substantially horizontal plane when the brackets are mounted on a said support.

15. The assembly of claim 13 wherein the plurality of brackets include:

at least one concealment panel bracket mounted on one of the supports and being configured to mount one of the concealment panels to the support; and at least one joiner panel bracket mounted on one of the supports and being configured to mount one of the joiner panels to the support.

16. The assembly of claim 15 wherein the plurality of brackets include:

a plurality of concealment panel brackets being positioned along a support perimeter of the support; and a plurality of the joiner panel brackets being mounted on one of the supports at separated locations on the support, the joiner panel brackets each being positioned in a gap between concealment panel brackets on the support.

17. The assembly of claim 15 wherein the at least one concealment panel bracket has a plurality of panel bracket sections with each of the concealment panel bracket sections being oriented nonparallel to each other.

18. The assembly of claim 15 wherein the concealment panel bracket being elongated in a direction of elongation being substantially horizontal when the concealment panel bracket is mounted on a said support of the antenna support assembly; and wherein the joiner panel bracket is elongated in a direction of elongation being substantially vertical when the joiner panel bracket is mounted on a said support of the antenna support assembly.

19. A concealment assembly for mounting on a transmission antenna apparatus including an elongate upstanding main pole and an antenna support assembly extending upwardly from the main pole to conceal from view the antenna support assembly, the concealment assembly comprising:

a plurality of concealment panels positionable in an array about the antenna support assembly and at least one antenna, each of the concealment panels being elongated with elongated side edges;

a plurality of joiner panels configured to join adjacent concealment panels, each joiner panel being configured to join adjacent side edges of the adjacent concealment panels;

an adapting frame structure configured to mount the concealment panels and the joiner panels on the antenna support assembly;

wherein one or more of the plurality of concealment panels have a plurality of ventilation slots therethrough;

wherein the antenna support assembly includes a base mounted on an apex of the main pole, a mast extending upwardly from the base, and a plurality of supports mounted on the mast at spaced locations along the length of the mast;

wherein the adapting frame structure comprises a plurality of brackets mountable on each of the supports of the plurality of supports to form a support perimeter on which at least the joiner panels are mounted;

wherein the plurality of brackets include:

at least one mounting bracket mounted on at least one of the supports; and at least one connecting bracket mounted on the at least one mounting bracket.

20. The assembly of claim 19 wherein the at least one mounting bracket comprises a plurality of mounting brackets mounted on the same said support; and wherein the at least one connecting bracket comprises a plurality of connecting brackets with each of the connecting brackets extending between at least two of the mounting brackets.

* * * * *